US007362206B1

(12) United States Patent
Herbert

(10) Patent No.: US 7,362,206 B1
(45) Date of Patent: Apr. 22, 2008

(54) VARIABLE TRANSFORMER

(76) Inventor: Edward Herbert, 1 Dyer Cemetery Rd., Canton, CT (US) 06019-2029

( * ) Notice: Subject to any disclaimer, the term of this patent is extended or adjusted under 35 U.S.C. 154(b) by 24 days.

(21) Appl. No.: 11/423,957

(22) Filed: Jun. 14, 2006

Related U.S. Application Data

(63) Continuation-in-part of application No. 10/904,371, filed on Nov. 6, 2004, now Pat. No. 7,119,648, which is a continuation-in-part of application No. 10/709,484, filed on May 8, 2004, now Pat. No. 6,979,982, and a continuation-in-part of application No. 10/708,846, filed on Mar. 27, 2004, now Pat. No. 7,023,317, application No. 11/423,957, which is a continuation-in-part of application No. 11/163,308, filed on Oct. 13, 2005.

(60) Provisional application No. 60/593,110, filed on Dec. 10, 2004, provisional application No. 60/479,706, filed on Jun. 19, 2003, provisional application No. 60/473,075, filed on May 23, 2003, provisional application No. 60/460,333, filed on Apr. 3, 2003.

(51) Int. Cl.
*H01F 27/28* (2006.01)

(52) U.S. Cl. ..... 336/220

(58) Field of Classification Search ..... 336/83, 336/92, 175, 200, 212, 220–223
See application file for complete search history.

(56) References Cited

U.S. PATENT DOCUMENTS

| | | | | | |
|---|---|---|---|---|---|
| 2,412,902 | A | * | 12/1946 | McElvain | 336/92 |
| 3,768,055 | A | * | 10/1973 | Oliver | 336/73 |
| 4,159,457 | A | * | 6/1979 | Charpentier | 336/183 |
| 5,093,646 | A | * | 3/1992 | Herbert | 336/225 |
| 6,137,392 | A | * | 10/2000 | Herbert | 336/175 |

* cited by examiner

*Primary Examiner*—Tuyen T. Nguyen

(57) ABSTRACT

A variable transformer has an effective turns ratio that can be varied by electronic switching. By varying the effective turns ratio, the output voltage can be controlled precisely for a varying input voltage and load regulation. The variable transformer is a modular transformer in which one or more of the modules can be effectively removed from the variable transformer by turning on an ac switch so as to short-circuit the secondary winding of the module. When the ac switch is on, the rectifiers of the module must be turned off, if they are synchronous rectifiers. If they are diodes, they will be off by being back-biased when the ac switch is on. Improved transformer modules are shown having reduced leakage inductance.

15 Claims, 12 Drawing Sheets

VARIABLE TRANSFORMER

CROSS REFERENCE TO RELATED APPLICATIONS

This application is a continuation in part of a patent application entitled "Coaxial Push-pull Transformers for Power Converters and Like Circuits", Ser. No. 10/904,371, filed Nov. 6, 2004, which issued on Oct. 10, 2006 as U.S. Pat. No. 7,119,648. That application is a continuation in part application of a patent application entitled "Switched-Current Power Converter", Ser. No. 10/709,484, filed May 8, 2004, which issued as U.S. Pat. No. 6,979,982 on Dec. 27, 2005. Priority is claimed to a provisional application entitled "Switch-current Power Converter", Ser. No. 60/473,075, filed May 23, 2003 and a provisional patent application entitled Parallel Current Sources for Switched-Current Power Converters, Ser. No. 60/479,706, filed Jun. 19, 2003. These applications are incorporated herein by reference.

Ser. No. 10/904,371 is also a continuation in part of a patent application entitled "Cellular Transformers", Ser. No. 10/708,846, filed Mar. 27, 2004, which issued as U.S. Pat. No. 7,023,317 on Apr. 4, 2006. Ser. No. 10/708,846 is a continuation in part of a provisional patent application of the same name, Ser. No. 60/460,333, filed Apr. 3, 2003. These applications are incorporated herein by reference. Priority is not claimed to these applications.

This application is also a continuation part of a patent application entitled "Total Charge Measurement", Ser. No. 11/163,308, filed Oct. 13, 2005. Priority is claimed to a provisional application entitled "Switched Current Power Converter", Ser. No. 60/593,110, filed Dec. 10, 2004. These applications are incorporated herein by reference.

This application is also a continuation in part of a patent application entitled "Dual Source MOSFET for Low Inductance Synchronous Rectifier", Ser. No. 10/905,668, filed Jan. 14, 2005. This application is incorporated herein by reference.

Reference is made to U.S. Pat. No. 4,665,357, entitled "Flat Matrix Transformer", which issued May 12, 1987.

Reference is made to U.S. Pat. No. 5,093,646, entitled "High Frequency Matrix Transformer", which issued Mar. 3, 1992.

Reference is made to U.S. Pat. No. 4,978,906, entitled "Picture Frame Matrix Transformer", which issued Dec. 18, 1990.

BACKGROUND OF THE INVENTION

This invention relates to transformers, and more particularly to high frequency "dc-dc" transformers for power conversion and the like, though it is not limited to that application.

Ser. No. 10/904,371 teaches a coaxial push-pull transformer using modules, and in particular teaches how to arrange and dispose the modules and their termination for low parasitic inductance through field cancellation in counter-flowing currents.

U.S. Pat. No. 7,023,317 teaches a cellular transformer.

U.S. Pat. No. 4,665,357 teaches a matrix transformer, and more particularly, teaches various embodiments of variable transformers.

U.S. Pat. No. 5,093,646 teaches an arrangement of the magnetic cores of a matrix transformer for improved high frequency characteristics, and in particular, reduced leakage inductance.

U.S. Pat. No. 4,978,906 teaches a method of minimizing leakage inductance by grouping together the terminals of adjacent transformer sections and treating them as if they were from the same transformer section. This can be done only if all of the sections of a transformer are operating in the same mode.

Ser. No. 10/709,484, FIG. 9, and 60/473,075 and 60/479,706 teach turning on both switches of a synchronous rectifier to short circuit a transformer winding.

Ser. No. 10/905,668 and 60/593,110 teach a coaxial transformer module having synchronous rectifiers and an ac shorting switch across the secondary push-pull winding. The ac shorting switch may be off and the synchronous rectifiers may be operated normally, or both of the synchronous rectifiers may be turned off and the ac shorting switch may be turned on to short circuit the secondary winding.

Additional information on matrix transformers and prior art variable transformers can be found in a tutorial, "Design and Application of Matrix Transformers and Symmetrical Converters", a seminar given by Edward Herbert at the Fifth International High Frequency Power Conversion Conference '90, in Santa Clara, Calif., May 11, 1990.

SUMMARY OF THE INVENTION

This invention teaches an improved variable transformer in which sections of the transformer are effectively removed by electronic switching to change its effective ratio. Synchronous rectifiers rectify the secondary current to provide a dc output current. To change the effective turns ratio, the synchronous rectifiers are turned off and an ac shorting switch is turned on.

This invention teaches improved coaxial and cellular transformer modules having their terminals grouped closely together, to reduce the leakage inductance in associated external circuits.

This invention teaches that the magnetic cores of the coaxial transformer modules may have recessed ends for terminal egress.

DETAILED DESCRIPTION

In the figures, like numbered items in different drawings designate the same part or an identical part.

Figure 1:
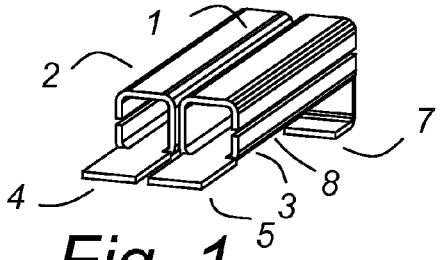
FIGS. 1 through 4 show the details of construction of a module for a coaxial push-pull transformer.

FIGS. 1 through 4 show the construction of a coaxial push-pull transformer module 20. A push-pull secondary winding 1 is made of two formed metal inserts 2 and 3 which are inserted into a magnetic core 9. The metal inserts have tab extensions 4 and 5 that are folded back after assembly as surface mount leads 21 and 22. Although they cannot be seen in the view of the finished module 20 in FIG. 4, similar surface mount leads are on the back edge of the module 20 on the bottom surface. One of them can be seen in FIG. 1 as a terminal 7, and the location of the other terminal 8 is hidden, but its location is indicated in FIG. 1.

The magnetic core 9 can be made of any suitable magnetic material, such as ferrite or pressed powdered metal, as examples, not limitations. The metal inserts 2 and 3 must be insulated from each other, as would be understood by one skilled in the art of transformers. As examples, not limitations, the windings 2 and 3 can be insulated from each other by an insulator between them or a tape or insulating coating applied to one or the other or both. The windings 2 and 3 can be bonded together with an insulating bonding material as a subassembly. As examples, not limitations, the bonding material could be double-sided adhesive tape or an adhesive such as epoxy having in it an aggregate that would keep the metal parts separated.

If the magnetic core 9 is not insulating, the magnetic core 9 must also be insulated from the metal inserts 2 and 3. As an example, not a limitation, the magnetic core 9 may be insulated by a coating such as epoxy. Instead of, or in addition to, insulating the magnetic core 9, the windings 2 and 3 may be coated with an insulating layer except at the contact area of the terminals 7, 8, 21 and 22.

Alternatively, and whether they are insulated or not, the metal inserts 2 and 3 may be keyed and kept apart by molded tabs 11, which lock the surface mount terminals 7, 8, 21 and 23 in place once they are folded back. Notice that the magnetic core 9 is relieved on the ends so that the conductors to the terminals 7, 8, 21 and 22 may be below the surface of the magnetic core 9 on the ends of the magnetic core 9.

Figure 4:
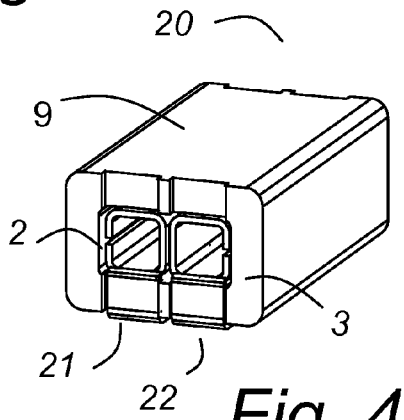
Figure 21:
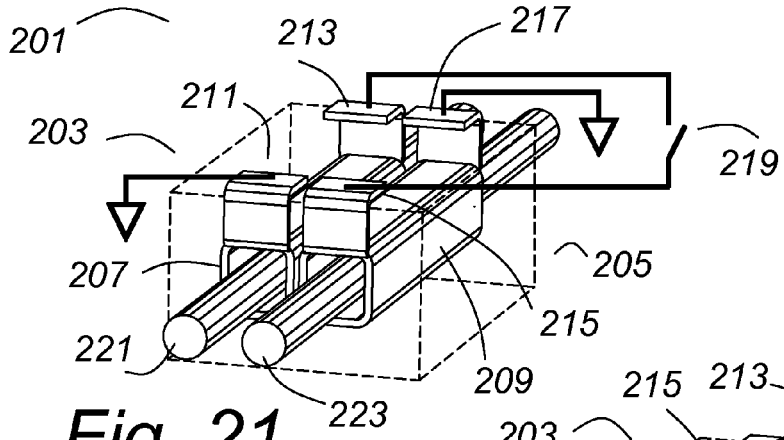
FIG. 21 shows a coaxial transformer module with the core in phantom view. External circuits are shown schematically.

The module 20 of FIG. 4 is based upon the module 200 of FIG. 21 of the parent application Ser. No. 10/904,371.

Figure 5:
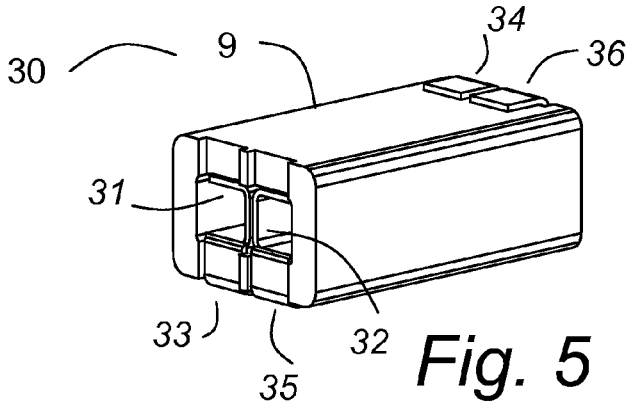
FIG. 5 shows a module for a coaxial push-pull transformer with an alternative terminal arrangement and alternative winding geometry.

FIG. 5 shows coaxial transformer module 30, which is similar to the module 20 of FIG. 4, except that the push-pull secondary winding is two metal inserts 31 and 32 that have terminals on opposite surfaces of the magnetic core 9, terminals 33 and 34 terminating the metal insert 31 and terminals 35 and 36 terminating the metal insert 32 respectfully on the bottom and top surfaces of the magnetic core 9.

In addition, the windings 31 and 32 are shown as "U" shaped channels, the "U" being sideways, with the bottoms of the "Us" facing each other. This "open coaxial" construction may be an acceptable trade-off against fully enclosed coaxial windings and it may be easier to make, particularly for prototypes or short production runs that do not justify more elaborate tooling.

Figure 6:
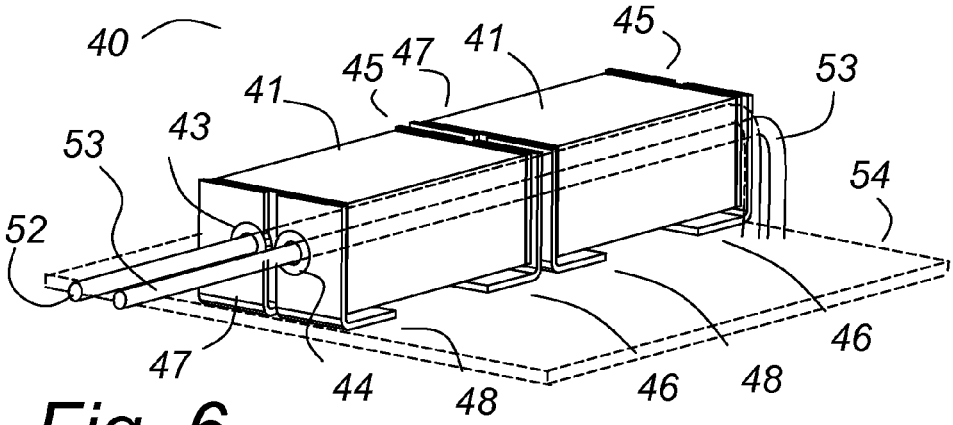
FIG. 6 shows two modules of a coaxial push-pull transformer with primary windings in place.
Figure 7:
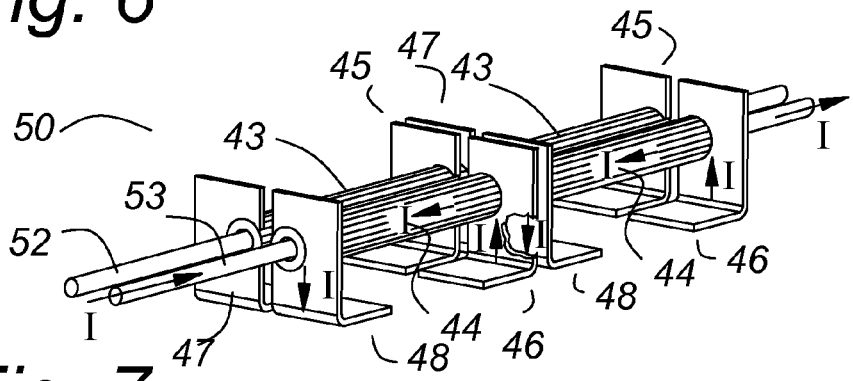
FIG. 7 shows the modules of FIG. 6 less the cores, and with current flow indicated by arrows.

FIG. 6 shows two modules 41, 41, a portion of a transformer 40, which may be mounted on a printed wiring board 54, shown in phantom. FIG. 7 shows the same portion of a transformer, but it is designated 50, the difference is that the magnetic cores are left out to show more clearly the secondary winding structure. The push-pull secondary windings comprise metal tubes 43 and 44 which are terminated on their respective ends by surface mount terminals 45, 46, 47 and 48.

Primary windings 52 and 53 pass through the tubes 43 and 44 respectively. When the primary winding 53 is conducting, current flow is as indicated by the several arrows designated I. Because the transformer modules 41 have single turn primary and secondary windings 53 and 44, 44, the currents flowing in the secondary windings 44, 44 equals the current flowing in the primary winding 53 (neglecting the magnetization current).

FIGS. 6 and 7 are based, respectively, on FIGS. 4 and 5 of Ser. No. 10/904,371.

Figure 8:
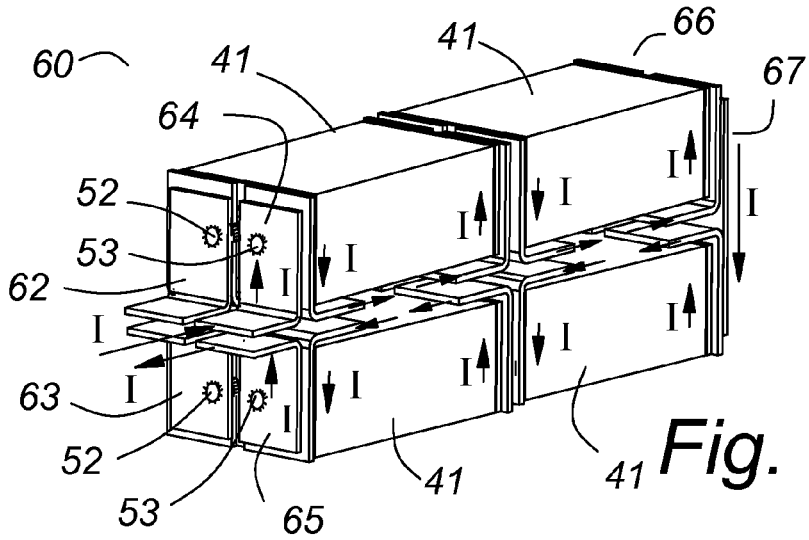
FIG. 8 shows a transformer comprising four coaxial push-pull modules with the primary winding in place. The current flow is indicated for one half of a push-pull cycle, showing that counter-flowing currents reduce the parasitic inductance.

FIG. 8 shows a finished transformer 60 based upon the subassembly 40 of FIG. 6. The transformer 60 has four modules 41-41, and the primary windings 52 and 53 are finished by terminating them respectively with surface mount terminals 62-65. On the opposite end of the transformer 60, the primary windings are connected from the top to the bottom through straps 66 and 67, though they could have been looped as shown in FIG. 6. (The strap 66 is hidden, but the reference designator indicates its location).

Again, the several arrows designated I indicate current flow when the primary winding 53 is conducting. It can be seen throughout the transformer, the current flow is balanced by counter-flowing currents, to reduce the parasitic inductance in the terminations of the transformer 60.

FIG. 8 is based upon FIG. 7 of Ser. No. 10/904,371.

Figure 9:
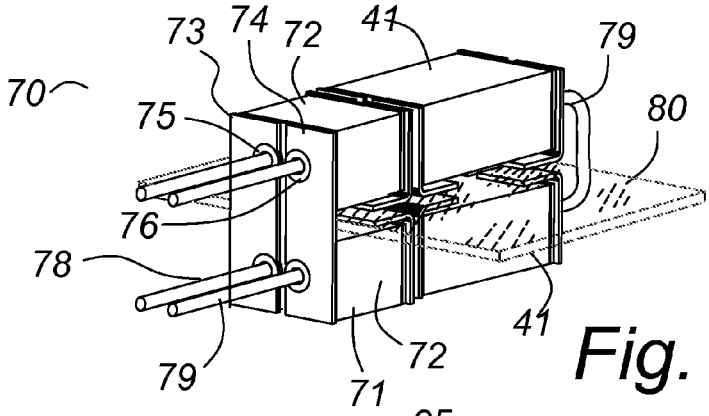
FIG. 9 shows a transformer comprising three coaxial push-pull modules, one of which is a "folded" module. A printed circuit board is shown in phantom.

FIG. 9 shows a transformer 70 that is made of two of the modules 41, 41 of FIG. 6 plus a special folded module 71. The folded module 71 is the electrical and magnetic equivalent of the modules 41, 41, but it is made of two smaller cores 72, 72, each in the order of one half of the size of magnetic cores of the modules 41, 41. The tubular secondary windings 75 and 76 are continued from the top to the bottom with bridging straps 73 and 74. The primary windings 78 and 79 return on the far end so as to pass through the transformer sections 41, 41 and 71 with the correct phasing. A circuit board 80, shown in phantom, may be between the top and bottom parts of the transformer and terminate the transformer sections 41, 41 and 71.

Figure 13:
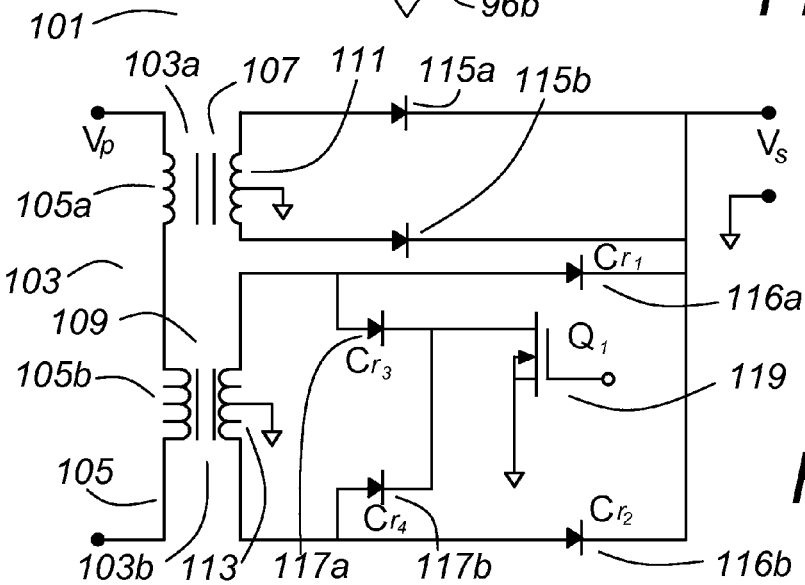
Prior Art Fig. 13
FIG. 13 shows a prior art variable transformer.

FIG. 9 is based upon FIG. 13 of Ser. No. 10/904,371.

Figure 10:
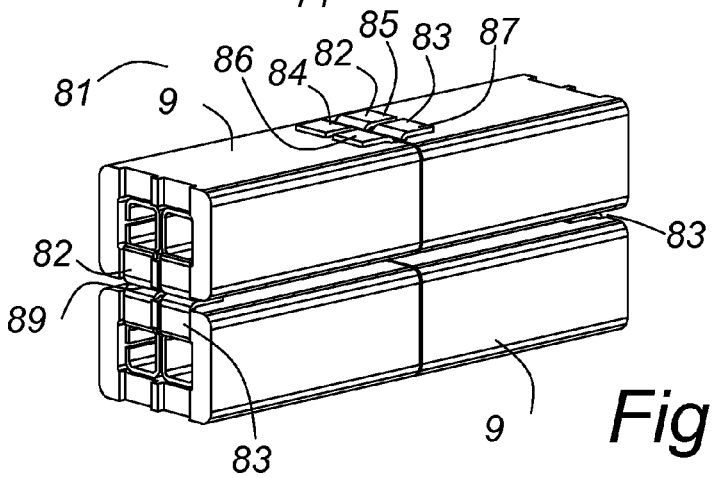
FIGS. 10 and 11 show a module of this invention, FIG. 11 being a section view of FIG. 10. The winding is "doubly folded" so that the terminations are closely grouped, to help minimize leakage inductance in the external circuits.
Figure 11:
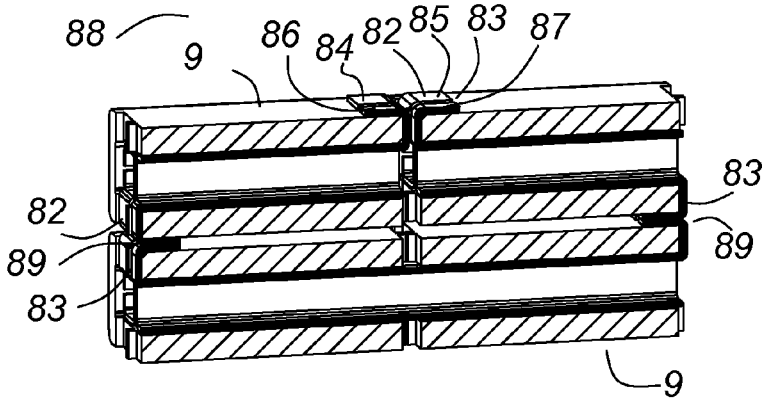

FIGS. 10 and 11 show a new folded module 81, FIG. 11 being a section view of the module 81 and designated 88. The modules have four cores, 9-9, being, as an illustration, not a limitation, the same core 9 as in FIG. 2. A first secondary winding 82 starts at a terminal 84, then passes through the four cores 9-9, ending at a terminal 85. A second secondary winding 83 starts at a terminal 86 and passes through the same four cores 9-9, parallel to the first secondary winding 82, ending at a terminal 87. As can be seen, particularly in the section view of FIG. 11, the top two module sections are similar to the module 30 of FIG. 5. The bottom section is similar to the module 20 of FIG. 4, except that it is inverted and the metal inserts are twice as long, extending through two cores 9, 9. The windings 82 and 83 have joints 89-89, which may be made by soldering the sections together, as an example, not a limitation. Spot welding could be used if the welds were made prior to folding. Conductive adhesive could be used. It is preferred that the joints 89-89 be made by a method that would not melt during subsequent soldering to a circuit board or the like, as by using a high temperature solder, as an example, not a limitation.

This module 81 has four times the flux capacity as the module 20 of FIG. 4 or the module 30 of FIG. 5. The flux capacity relates to volt-second product, as would be understood by one skilled in the art of transformers. Accordingly it may be rated at four times the voltage (if the frequency is the same) or at one fourth the frequency (if the voltage is the same) or at some other combination of voltage and frequency having the same volt-second product. (This is modified if a particular application uses a greater or lesser maximum flux density, as would be well understood by one skilled in the art of transformers.)

The module 20 of FIG. 4 is well suited for a low voltage, high frequency transformer, as the terminals are reasonably closely spaced. None the less, the external connections are the length of the core 9. For example, note that in the transformer of FIG. 8, in the center where a circuit board might be installed with switches, the counter-flowing currents are across the distance between respective terminals, and it is only by virtue of an identical circuit piggy-backed that the currents can be said to be counter-flowing everywhere.

For higher voltage operation, requiring longer cores (or several, stacked end to end), this space may be quite long.

The special folded module 71 of FIG. 9 also has its terminals ending at the same place, though on opposite sides of the circuit board 80. To be close together, the terminals are within the transformer, which may be inconvenient for some circuit connections.

In the module 81 of FIG. 10, the ends of the secondary winding are grouped very closely together, no matter how large or how long the magnetic cores become. Further, they may be on the outside surface of the transformer. Obviously, by using sections with the terminals facing inward, the section may be terminated in a close group within the transformer, between the top and bottom parts, if desired.

U.S. Pat. No. 4,978,906, entitled "Picture Frame Matrix Transformer", which issued Dec. 18, 1990, taught a transformer in which the terminations of adjacent sections were treated as if they were from the same section, the currents being equal. This works well as long as the entire transformer operates in the same mode, and the module 20 of FIG. 4 could be similarly paired, with good performance even if the cores were long (or several were stacked end to end). However, this invention teaches a variable transformer, in which the sections may operate in different modes, so the teachings of U.S. Pat. No. 4,978,906 cannot be used, unless all of the sections are switched on and off synchronously, a possible though not preferred mode of operation.

U.S. Pat. No. 4,978,906 teaches a matrix transformer that has been optimized for high frequency operation. As in the present invention, the terminals of the transformer sections have been grouped together so as to minimize leakage inductance. U.S. Pat. No. 4,978,906 uses sets of four cores with tapered ends arranged in a repeating square pattern. The windings are plain wire. U.S. Pat. No. 4,978,906 does not teach nor anticipate using a variant of the coaxial transformer or the cellular transformer arranged in parallel rows, and it would not be obvious to one skilled in the art of transformers to make the modules of the present invention from the teachings of U.S. Pat. No. 4,978,906.

Figure 12:
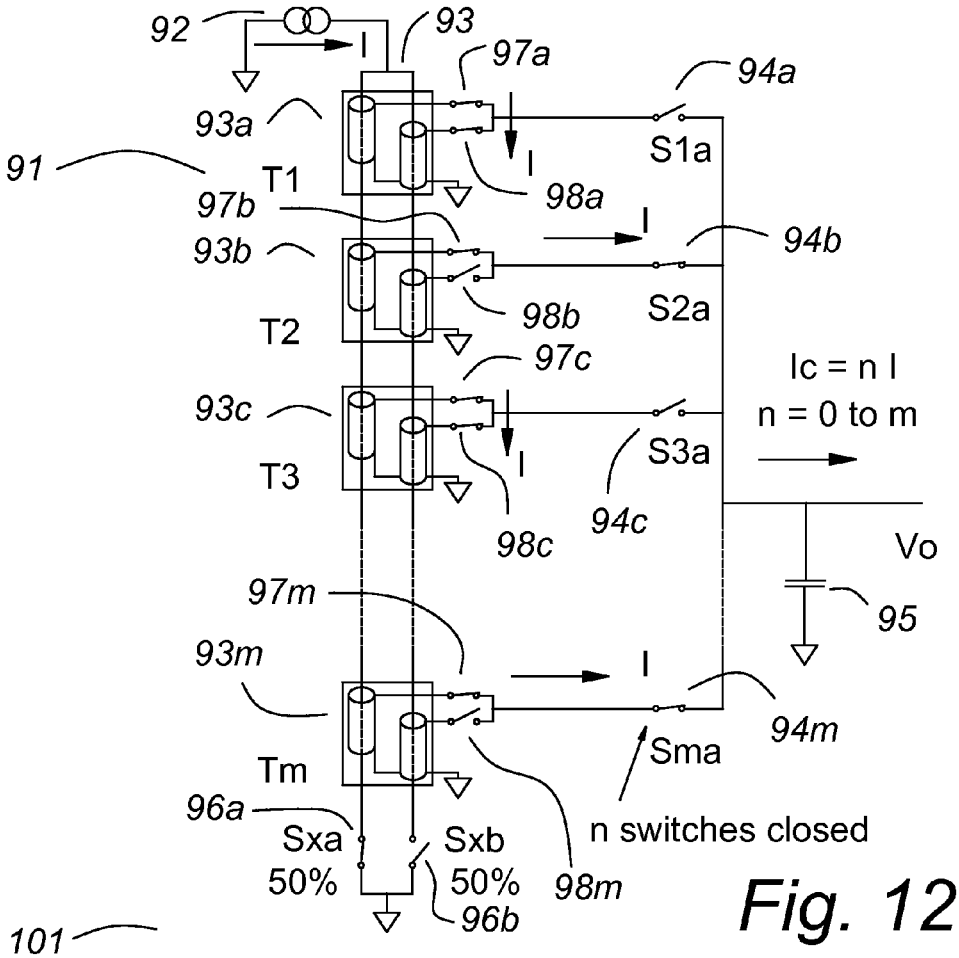
FIG. 12 shows a schematic diagram of a variable coaxial push-pull transformer for a switched current power converter.

FIG. 12 shows a variable transformer circuit, configured as a switched current power converter 91. The switched current power converter is taught in U.S. Pat. No. 6,121,761, entitled "Fast Transition Power Supply", which issued Sep. 19, 2000. FIG. 12 is based upon FIG. 9 of U.S. Pat. No. 6,979,982, entitled "Switched Current Power Converter", which issued May 8, 2004.

FIG. 12 shows a switched-current power converter 91 comprising a constant current power source 92 and a matrix transformer 93 comprising elements **93*a*-93*m*. Switches 96*a* and 96*b* provide a 100 percent duty-cycle push-pull excitation. A plurality of switches 94*a*-94*m* may be closed to direct a constant current to an output capacitor 95 and a load (not shown) on an output Vo, or they may be open. When current is flowing to the output capacitor 95 and the load, the plurality of switches 97*a*-97*m* and 98*a*-98*m* are operated as synchronous rectifiers for the matrix transformer 93 as would be well known to one skilled in the art. Logic (not shown) is used to turn on both switches 97*a*-97*m* and 98*a*-98*m* for those elements 93*a*-93*m* for which the current is not switched to the load. The current can circulate through the synchronous rectifiers within the transformer, as shown for elements 93*a* and 93*c***.

In U.S. Pat. No. 6,979,982, the circuit of FIG. 12 is characterized as a switched current power converter 91, but the matrix transformer 93 can also be used as a variable transformer. U.S. Pat. No. 6,979,982 is the first example to teach the short-circuiting of both halves of a push-pull secondary winding. By shorting both halves of the push-pull secondary winding, the circulating current in the short-circuited state is one half what it is if only one side of the push-pull winding is short-circuited. Because losses are a function of the square of the current ($I^2R$), the losses in the transformer element is one half even though the resistance factor is double.

The plurality of switches **94*a*-94*m* are necessary to prevent a short circuit of the output voltage Vo during the time that both of the synchronous rectifiers 97*a* to 97*m* and 98*a* to 98*m* of any element 93*a*-93*m* of the matrix transformer 93 are on. This extra series switch 94*a*-94*m* is an extra loss when the synchronous rectifiers 97*a* to 97*m* and 98*a* to 98*m* are alternating and the current is going to the output capacitor 95** and the load, a problem that is solved by the present invention.

Figure 3:
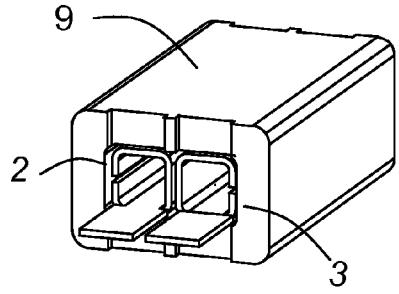
Figure 2:
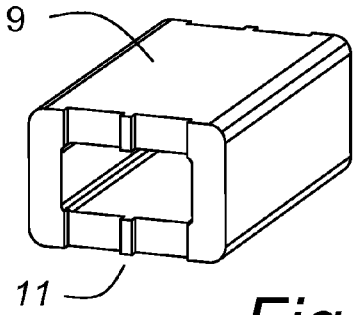

FIG. 13 shows a prior art variable matrix transformer 101, which is based upon FIG. 3.9 of the tutorial "Design and Application of Matrix Transformers and Symmetrical Converters". FIG. 13 is traced from FIG. 3.9 of the tutorial, and is the same except for the numeric reference designators, which were added for this specification.

A primary winding 105, excited by a voltage source Vp, and consisting of two primary winding sections 105*a* and 105*b*, passes through first and second elements 103*a* and 103*b* of a matrix transformer 103. The matrix transformer 103 has two magnetic cores 107 and 109, and two secondary push-pull windings 111 and 113. Under normal operation, rectifiers 115*a*, 115*b*, 116*a* and 116*b* rectify the current from the secondary windings 111 and 113, and the currents are taken in parallel to an output Vs. The equivalent turns ratio is 2:1.

If a MOSFET 119 is turned on, the current from the second element 103*b* of the matrix transformer 103 is shunted to ground through the rectifiers 117*a* and 117*b*, which back biases the rectifiers 116*a* and 116*b*. This effectively short-circuits the second element 103*b* of the matrix transformer 103, effectively removing it from the output and effectively changing the equivalent turns ratio from 2:1 to 1:1. In 1990, synchronous rectifiers were not practical for power converters.

When the MOSFET 119 is turned on, one side only of the secondary winding 113 is short-circuited, depending upon the polarity of the exciting voltage Vp. Only one of the rectifiers 117*a* or 117*b* will be forward biased, and thus conducting. Accordingly, the full secondary current circulates when the secondary is short-circuited, in contrast to the half of the current that flows in the present invention.

Figure 14:
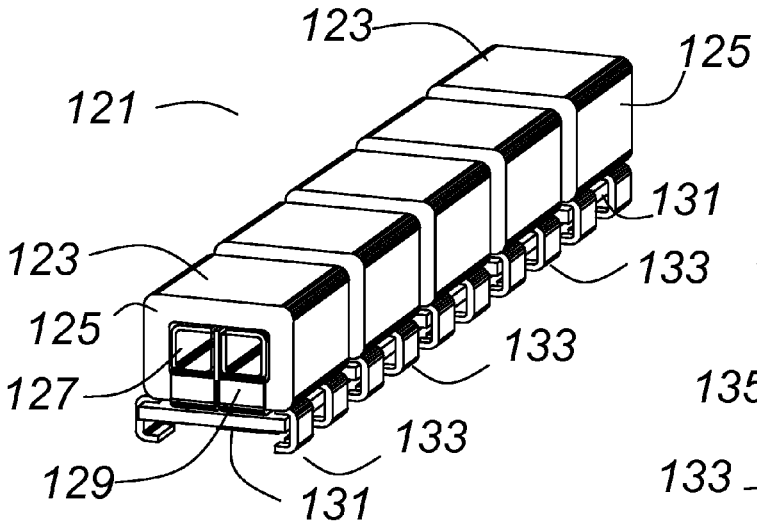
FIG. 14 shows five coaxial push-pull transformer modules each of which has a small circuit board intimately attached for minimal parasitic inductance.

FIG. 14 shows five elements 123-123 of a coaxial transformer 121. Coaxial secondary windings 127 are in place in magnetic cores 125-125. A primary winding (not shown) will be inserted through the aligned through holes in the elements 123-123. Attached to the five elements are five small circuit boards 131-131. Alternatively, one larger circuit board could be used. The terminals 129 of the transformer elements 123 attach directly to the circuit boards 131 for minimal parasitic impedance. Circuit board terminals 133-133 connect to external circuits, probably on a motherboard or a larger assembly.

Figure 15:
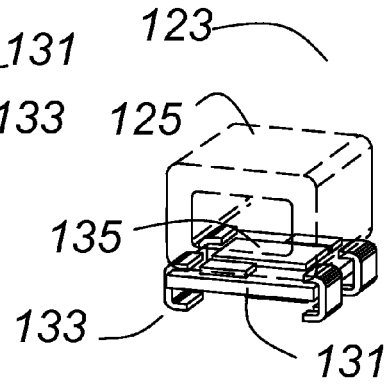
FIG. 15 shows one module with the core in phantom so that that hypothetical components of the circuit board can be seen.

FIG. 15 shows one of the elements 123 of the coaxial transformer 121 of FIG. 14, except the core 125 is shown in phantom so that the integrated circuits 135 on the circuit board 131 can be seen.

FIGS. 14 and 15 are the FIGS. 13 and 14 of Ser. No. 10/905,668, and are based upon FIG. 32 of 60/593,110.

Figure 16:
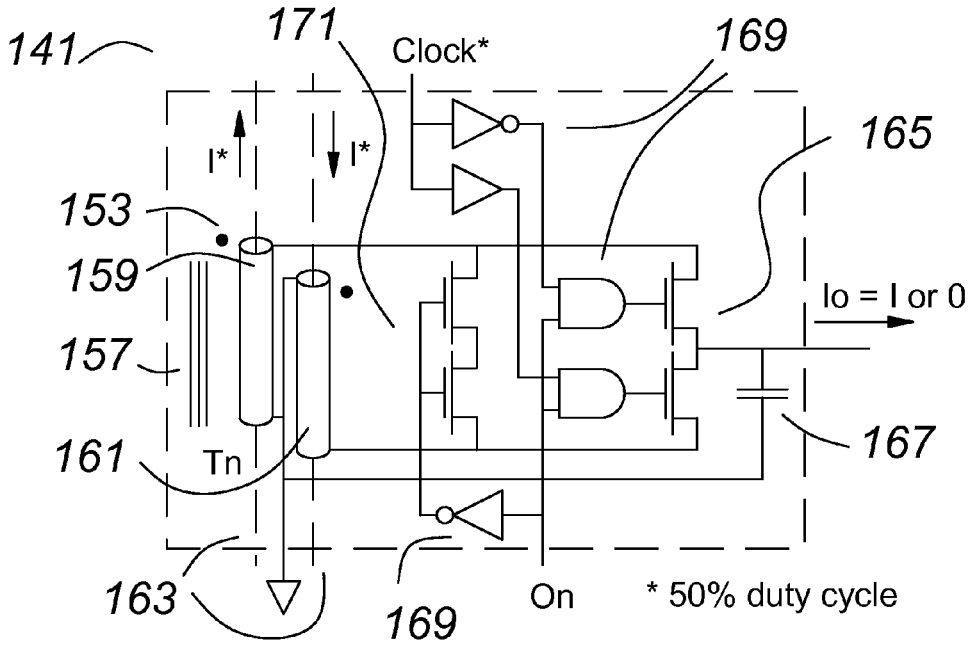
FIG. 16 shows a schematic diagram of one module of a variable transformer of this invention.
Figure 17:
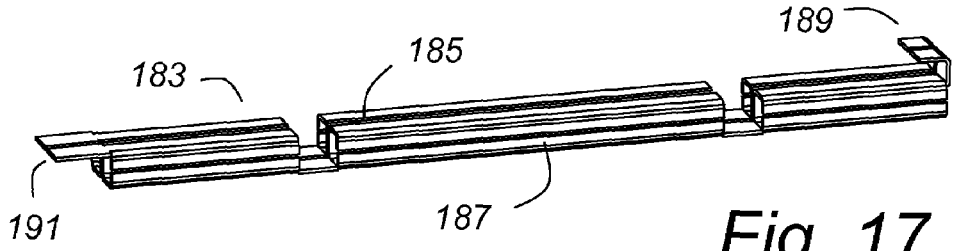
FIGS. 17 through 20 show an alternative folded coaxial transformer module having no internal connections in its secondary winding.

FIG. 16 shows a circuit 141 which could be the circuit on the circuit boards 131 of FIGS. 14 and 15, as an example, not a limitation. One section of a coaxial transformer 153 is shown having a magnetic core 157 and two secondary windings 159 and 161, which are the two halves of a push-pull (center-tapped) secondary winding. A push-pull primary winding 163 passes through the two secondary windings 159 and 161 of the push-pull secondary winding in the manner of a coaxial push-pull transformer, as explained in this specification and its parent applications. The phasing of the push-pull secondary windings 159 and 161 is shown using the familiar dot convention, and the center-tap is shown connected to return.

This circuit 141 is to control a section of a variable transformer, and using it with the coaxial push-pull transformer is the preferred embodiment of this invention, but the coaxial push-pull transformer is shown as an example, not a limitation. The same circuit and control methods may be applied to cellular transformers (U.S. Pat. No. 7,023,317) and other matrix transformers.

In the variable transformer, the section of the coaxial transformer 153 may operate normally by operating synchronous rectifiers 165 as in any transformer secondary circuit to rectify the output of the push-pull secondary windings 159 and 161 to an output capacitor 167 and a load (not shown). In the example, the output current will be I, the same magnitude as the primary current I (annotated by an asterisk * as being 50% duty-cycle—meaning that each side of the primary current has a 50% duty-cycle so that the secondary output current, when rectified, is a dc current). A Clock input, (also annotated as 50% duty-cycle), controls the synchronous rectifiers 165 through logic 169. An On logic input enables the synchronous rectifiers 165. This logic and synchronizing method is shown as an example, not a limitation. One skilled in the art of power conversion would know how to design appropriate control means for diverse applications and requirements.

To change the ratio of a variable transformer, one or more sections of the transformer are effectively removed by electronic switching. In the example of the circuit 141 of FIG. 16, the On input is brought low and inverted by an inverter 169 to turn on an ac shorting switch 171, shown as an example, not a limitation as back-to-back MOSFETs.

In contrast to prior methods of controlling a variable transformer, it is both sections of the push-pull secondary windings 159 and 161 that are shorted, effectively two turns in series, so that the short circuit current circulating in the push-pull secondary windings 159 and 161 and the ac shorting switch 171 is one half of the magnitude of the primary current I. Further, in contrast to the circuit of FIG. 12, no additional series switch is needed for normal operation.

Figure 29:
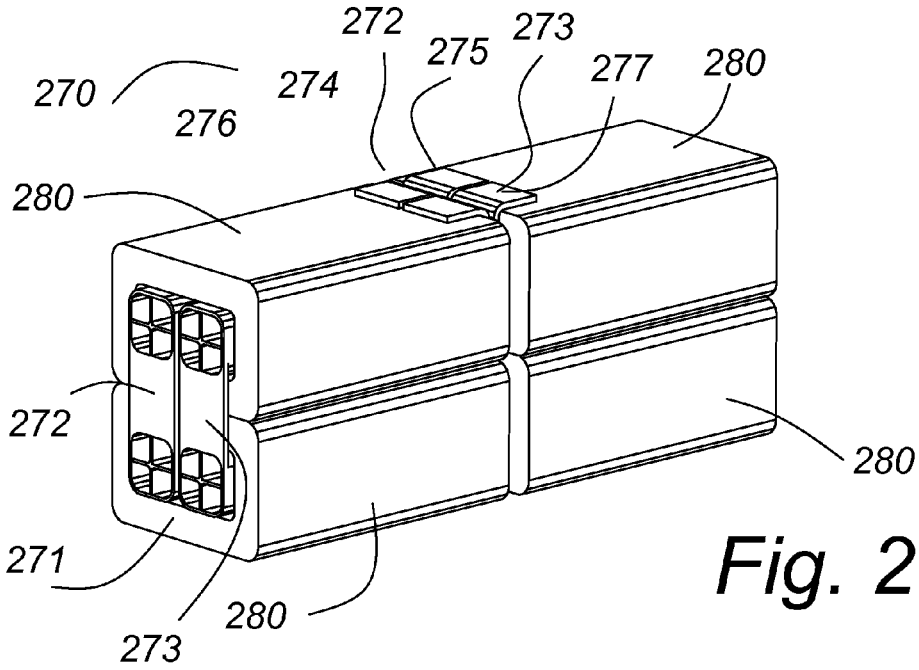
FIG. 29 shows a folded cellular transformer module.

FIG. 16 is based upon FIG. 29 of 60/593,110 and FIG. 15 of Ser. No. 10/905,668.

In the examples in this specification, push-pull secondary windings are shown with a rectifier in each side of the push-pull secondary winding to produce a full-wave rectified output. An alternative transformer could use the familiar full-wave bridge of four rectifiers to achieve a full-wave rectified output, using either synchronous rectifiers or diodes. A full-wave bridge is usually connected to the start and the end of a secondary winding, and so is the ac shorting switch of this invention. No center-tap connection is needed. For this specification and the claims, a full-wave bridge connected to the start and to the end of a secondary winding is the equivalent of a push-pull secondary winding with two rectifiers in that both circuits produce a full-wave rectified output. A transformer module of either configuration may be "removed" from a variable transformer by turning off the rectifiers and turning on an ac switch connected to the start and to the end of the secondary winding. If synchronous rectifiers are used, they are turned off by the control logic. If diodes are used, they are turned off by turning on the ac switch, which will cause them to be back biased.

FIGS. 17 through 20 show a folded coaxial push-pull transformer section 181. Functionally, it is the equivalent of the transformer section 81 of FIG. 10, but its construction avoids the need to join the top and bottom sections together with soldered joints or the like. A coaxial push-pull secondary winding 183 is made of two tubular secondary windings 185 and 187. At one end, start terminals 189 may be preformed to be surface mount terminals. On the other end, end terminals 191 are flat initially so that the secondary winding 183 may be inserted through the magnetic cores 192-195, which may be the core 9 of FIG. 4, as an example, not a limitation. (The terms "start" and "end" are borrowed from usual jargon of the transformer art, and indicate phasing of the winding). Along the length of the secondary winding 183 the tubular secondary windings have been notched to facilitate subsequent folding operations.

Figure 18:
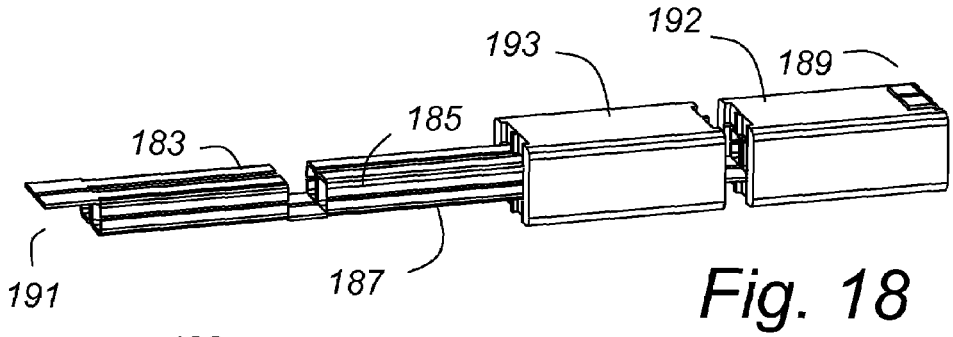
Figure 19:
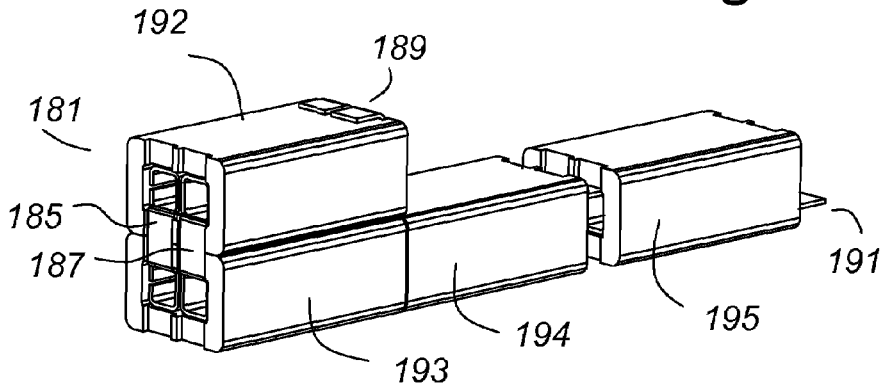
Figure 20:
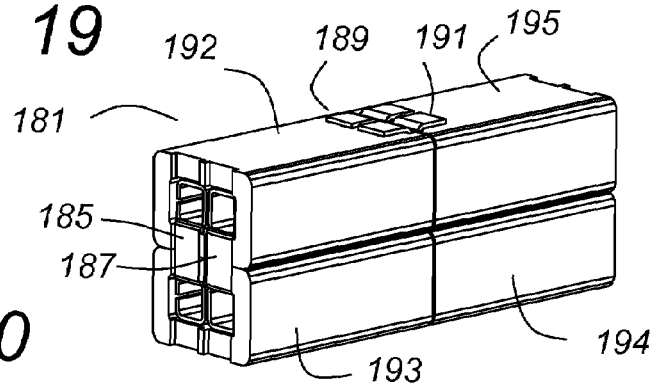

FIG. 18 show two cores 192 and 193 installed. In FIG. 19, four cores 192-195 have been installed, and the transformer section 181 has been folded once, leaving the start terminals 189 at the top of the transformer section 181 with one core 192 and the rest of the transformer section 181 folded back underneath it. The tubular secondary windings 185 and 187 are tight against the end of the transformer section 181 where it is folded. In FIG. 20, the final fold has been made, and the end terminals 191 have been formed as surface mount terminals.

By folding the transformer section 181 twice, the start and end terminals 189 and 191 are brought together in a tight pattern so that the external circuitry can be connected with optimally low parasitic impedance. When a section is very short, as in the module 20 of FIG. 4, the physical spacing between the terminals is less critical and may indeed be optimum if the spacing closely matches the terminal spacing of a rectifying circuit or a control circuit for a variable transformer. In transformers requiring a higher flux density and/or a lower frequency of operation, longer cores may be required, and the space between the terminals can be significant. By folding the section, the terminals may be tightly grouped for low parasitic inductance in such external circuits.

In FIG. 20, four equal sized cores 192-195 are used, and the terminals 189, 191 are in the center at the top. This is as an example, not a limitation. The cores may be of different length or may be made of different numbers of cores stacked in series to achieve a required effective magnetic area, as would be well understood by one skilled in the art of transformers. As long as two folds are made, and the total length of the cores in the top row approximately equals the total length of the cores in the bottom row, the object of this invention are achieved. The terminals need not be at the center but could be offset.

Then folding of the transformer section 181 of FIG. 20 into top and bottom parallel rows anticipates aligning this transformer section 181 in a row with like transformer sections to make a finished transformer. While this is a preferred design, the object of this invention may be achieved with other folding arrangement, such as folding the four cores 192-195 (or more cores) as a rectangle or other polygon, as long as the start and end terminals are brought close together and there are no large gaps between the various cores of the transformer section. While this complicates threading through the primary winding, it is equivalent magnetically and electrically, and may suit peculiar applications. In this specification and the claims, reciting two folds includes other geometries with more than two folds.

For this specification and the claims, a transformer module is defined as being "a folded module" if the module is constructed as taught in FIG. 9, 10, 20 or 29 so that the start terminals, the center-tap terminals and the end terminals are brought very close together in a tight pattern to minimize the leakage inductance of the external circuits.

FIG. 21 shows the connections for a secondary winding circuit 201 for short-circuiting a section 203 of a variable transformer. The magnetic core 205 is shown in phantom to show more clearly the tubular secondary windings 207 and 209. Primary windings 221 and 223 pass through the respective tubular secondary windings 207 and 209. Two terminals 211 and 217 of the tubular secondary windings 207 and 209 are the center-tap, and they may be connected to return. The return is assumed to be a ground-plane or other very low impedance connection. The start and end terminals 213 and 215 are taken to an ac shorting switch 219, which may be closed to effectively remove the section 203 from the variable transformer to effectively change its effective turns ratio. The terminology "start" and "end" is borrowed from the art of transformers and indicate phasing.

An ac switch is defined as a switching device that will conduct current in either direction when on, and which will block current of either polarity when off. As an example, not a limitation, back-to-back MOSFETs may be configured as an ac switch.

The very low inductance and excellent coupling in a coaxial push-pull transformer are due to a large part to the coaxial nature of the conductors, the primary winding being a center conductor in a coaxial secondary conductor and having appropriate external circuits and connections to ensure the same phasing in the primary and secondary. When both halves of a push-pull secondary winding are short-circuited by an ac switch, the circulating current is one half of the push-pull primary current. When the current of the phase of the push-pull primary that is on passes through the corresponding coaxial secondary winding, and an equal and opposite counter-flowing current will flow, initially, on the inside surface of the coaxial secondary winding. To satisfy the transformer relationships, only half of this current leaves the transformer through the terminals, and the other half circulates back on the outside of the coaxial secondary winding. This in turn induces an equal and opposite current in the second secondary winding, and this current also leaves the transformer through the terminals, being the same series current.

Figure 22:
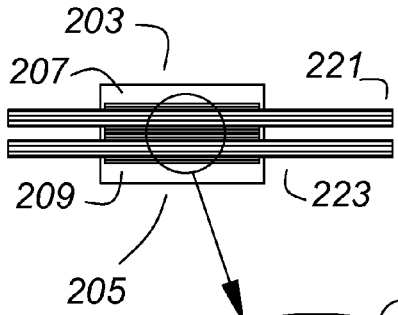
FIGS. 22 and 23 show the current flow within a module when the ac shorting switch is closed.
Figure 22:
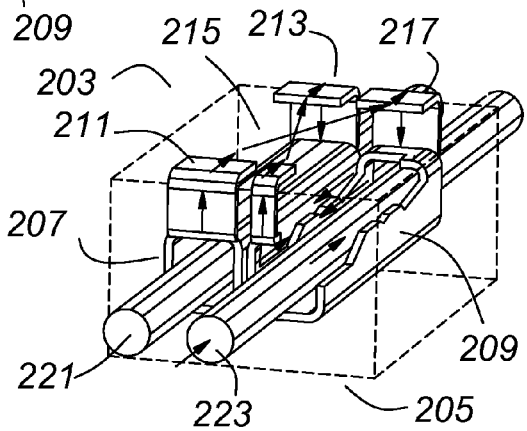

To maintain optimally low parasitic series inductance, the two halves of the push-pull secondary winding must be well coupled, and this is accomplished by having their surfaces closely proximate one to the other and as wide as practical. In FIGS. 21 and 22, it can be seen that the two tubular secondary windings 207 and 209 meet this criterion.

FIG. 22 shows the same section 203 of the variable transformer, but part of the tubular secondary winding 209 has been cut away. The current flow through the tubular secondary windings 207 and 209 as well as the primary winding 223 is shown by arrows. The current flow is also shown by arrows flowing directly from terminal to terminal, replacing the external switch and return connections with their equivalent circuit for the condition of the ac shorting switch 219 being closed.

Figure 23:
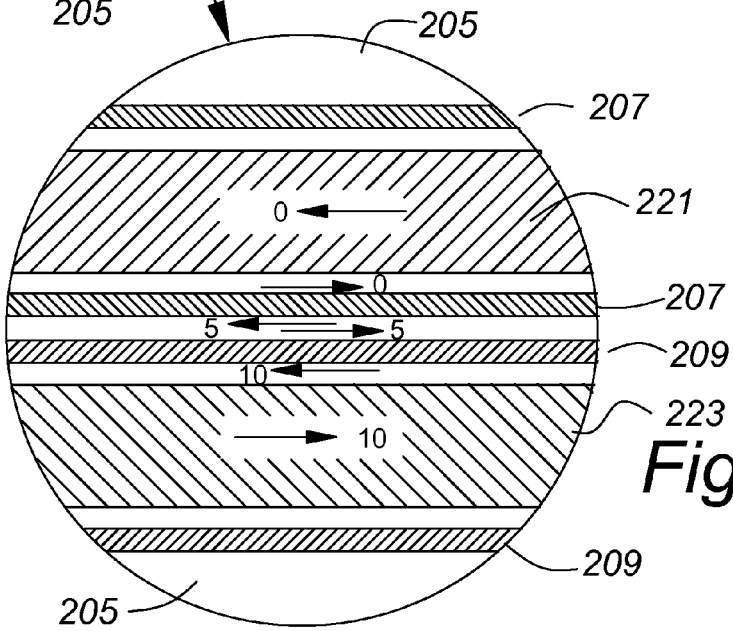

FIG. 23 shows an internal view of the section 203 of the variable transformer. The like numbered parts are the same in the several drawings. In FIG. 23, a large scale blow-up shows the current flow in the middle of the section 203 of a variable transformer when the ac shorting switch 219 of FIG. 21 is closed. A current of 10 A flows in the primary winding 223. 10 A is an example, not a limitation. The relationship will hold proportionately for any current. The magnetization current is neglected. This induces a counter-flowing current of 10 A in the inside of the tubular secondary winding 209. Because the tubular secondary windings 207 and 209 are connected together in series by the external circuitry, they carry the same current, passing twice in the same direction through the transformer core 205. Because the net ampere-turns in a transformer must be zero (neglecting the magnetization current), the current in each of the tubular secondary windings 207 and 209 must be 5 A. Because 10 A is flowing in the inside of the tubular secondary winding 209, and 5 A is flowing in the series circuit of the tubular secondary windings 207 and 209, 5 A must flow back on the outside of the tubular secondary winding 209.

This in-turn, induces a counter-flowing current of 5 A on the outside surface of the tubular secondary winding 207 in the opposite direction. This is the same 5 A current that flows in the series circuit.

In time, the 10 A flowing on the inside surface of the tubular secondary winding 209 and the 5 A flowing on the outside surface will blend as a net current of 5 A, but initially the high frequency effects, and in particular, the skin effect (penetration depth), keeps these currents separated. It is during this initial period that parasitic impedance, and in particular, the parasitic inductance, is so critical. Note that the facing surfaces of the first and second tubular secondary windings 207 and 209 are broad and closely spaced and have counter-flowing equal currents for cancellation of the far field, minimizing of the leakage inductance.

Figure 24:
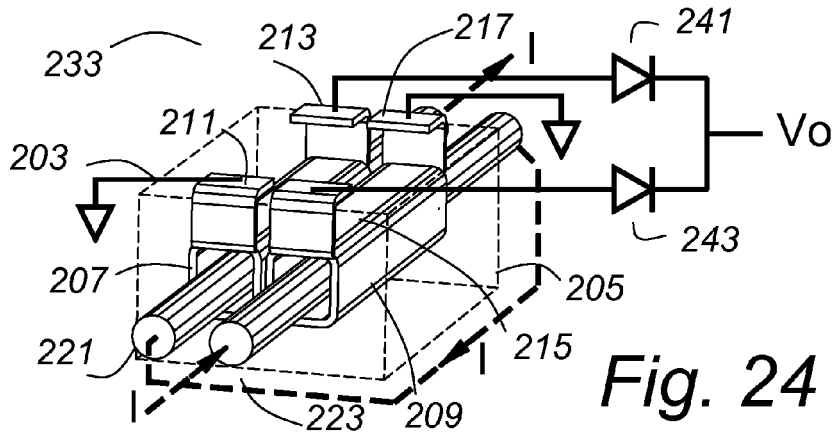
FIGS. 24 through 26 show that features of the coaxial transformer module that reduce leakage inductance during the time that it is shorted also reduce leakage inductance during the on state if a single primary winding is used, and show the current flow for that condition.
Figure 25:
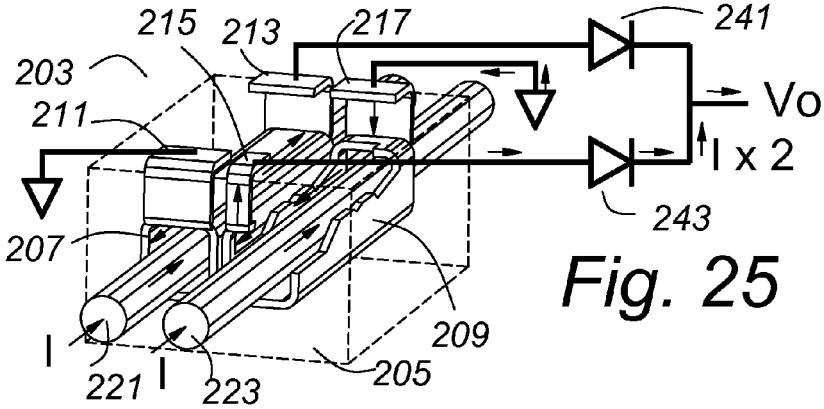
Figure 26:
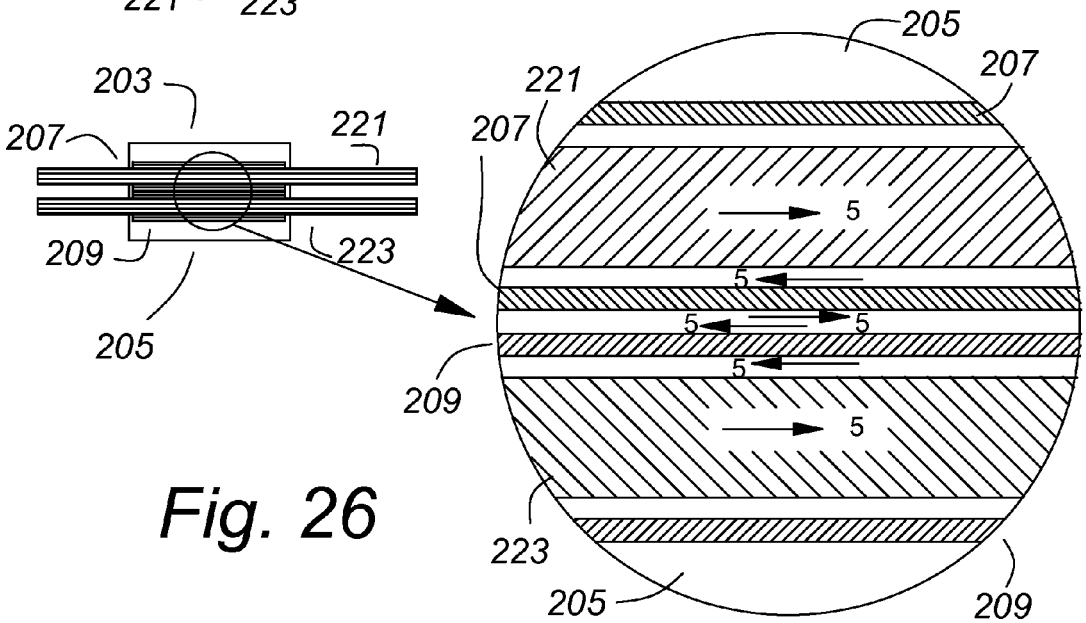

FIGS. 24 through 25 show the same section 203. However, the circuit as a whole is designated 233 because the external circuits are different, and a different mode of operation is shown. FIGS. 24 through 26 show that the same features that facilitate low inductance in the tubular secondary windings 207 and 209 also facilitate low inductance if the primary windings 221 and 223 are used in series as a single primary winding. Ser. No. 10/904,371 teaches that it is preferred to have a push-pull primary winding. Ser. No. 10/904,371 also teaches that for the topologies that usually have a single primary winding, such as a half-bridge or full-bridge topology, it is preferred to use two parallel primary windings of equal turns, each passing through one side push-pull secondary winding.

For transformers having a large turns ratio, it will cut the total turns in half and make a simpler construction if a single primary winding passes in series through both halves of the push-pull secondary winding. By definition, a "full wave primary winding" is a single primary winding passing in series through both halves of the push-pull secondary windings of all of the modules. This contrasts with a "push-pull primary winding" in which, by definition, has a first half of the push-pull primary winding that passes in series through the first halves of the secondary windings of all of the modules and a second half of the push-pull primary winding that passes in series through the second halves of the secondary windings of all of the modules.

Many power converters have a power factor correction circuit as their input, and a primary voltage sourced from such an input may have a voltage of 400 V or more, as an example, not a limitation. A modern computer-type electric circuit may require an output voltage of 3.3 V, or less, as an example, not a limitation. For design purposes, the effective input voltage is a little less, and the output voltage is a little more, to allow for series voltage drops in other components, but a turns ratio in the order of 120 to 1 is needed for a full-bridge topology, and half that, or 60 to 1 for a half-bridge topology, as an example, not a limitation. Doubling the winding in order to use the preferred winding configuration significantly increases the design complexity and may be justified only for high power transformers. Accordingly, there is an incentive to use one winding in series, as shown in FIGS. 24 through 26.

FIG. 24 shows the primary current I flowing into the near end of the primary winding 223, then out of the far end. It may pass through any number of other magnetic cores or other components, but it returns as an unbroken series path to once again enter the section 203 of the variable transformer through the other primary winding 221, and on, the primary winding of the whole variable transformer of which this is one module being thus connected in series. The tubular secondary windings 207 and 209 have, respectively, a start termination 215 and an end termination 213, and are connected externally to a full wave rectifier comprising rectifiers 241 and 243 to provide an output voltage Vo. The rectifiers 241 and 243 are shown schematically as diodes, but that is for illustration, not as a limitation, to keep the drawing simple. It is usually preferred to use synchronous rectifiers. The terminology "start" and "end" is borrowed from the art of transformers and indicate phasing. In the example, the secondary winding also has a center-tap termination comprising terminals 211 and 217, which are connected externally, preferably in a ground plane or with another very low impedance connection.

FIG. 25 shows the current flow in the secondary circuit for the direction of primary current flow shown in FIG. 24. FIG. 26 shows an enlarged section in the center of the section 203 of the. In both primary windings 221 and 223, 5 A is flowing, as shown. The 5 A is an example, not a limitation, the relationships will hold proportionately for any current. Magnetization current is neglected. Counter-flowing currents of 5 A will flow in the inside surface of the tubular secondary windings 207 and 209. However, because the external connection of the tubular secondary winding 207 is to a rectifier 241 that is reversed biased, no current will flow to the external circuit through the terminals. Instead, the 5 A current will flow back on the outside surface of the tubular secondary winding 207. This will induce a counter-flowing 5 A current on the outside of the tubular secondary winding 209, which will combine with the 5 A current on the inside of the tubular secondary winding 209 as the output current to the forward biased rectifier 243 and the load (not shown) on the output Vo.

Figure 27:
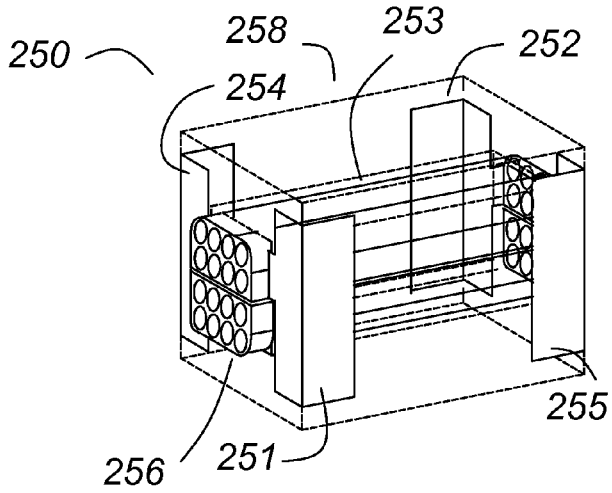
FIG. 27 shows a cellular transformer module.

FIG. 27 shows a section 250 of a cellular transformer. A transformer core 259 is shown in phantom, to better illustrate the windings. A first cellular secondary winding 253 is terminated to terminals 251 and 251. A secondary cellular secondary winding 256 is terminated to terminals 254 and 255. Alternative connections are possible.

The cellular transformer is taught in U.S. Pat. No. 7,023,317, and FIG. 27 is based upon FIG. 9 of that patent. A cellular transformer operates very similarly to a coaxial transformer except that it is designed for a multiple turn primary winding. All of the secondary connections and circuits taught herein are equally applicable to cellular transformers, and when a coaxial transformer is recited in the claims, a cellular transformer is included. All of the discussions of FIGS. 21 through 26 are equally applicable to the cellular transformer section 260 of FIG. 27, as they have in common closely spaced and wide conductive surfaces for good coupling and low parasitic inductance of their respective push-pull secondary windings. (For a multiple turn primary, "ampere-turns" replaces "amperes" in the examples, as would be well known to one skilled in the art of transformers.)

Figure 28:
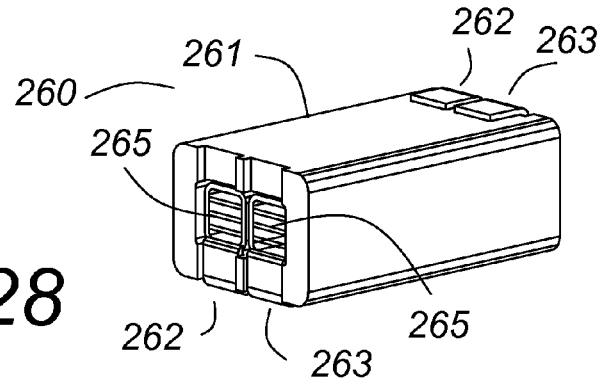
FIG. 28 shows an alternate cellular transformer module, for flat primary conductors, or, perhaps, ribbon wire conductors.

FIG. 28 shows a cellular transformer module 260, loosely based upon the module 20 of FIG. 4 or the module 30 of FIG. 5. A magnetic core has therein two coaxial secondary windings 262 and 263. Six dividers 265-265 have been inserted into the windings 262 and 263 to make the cellular transformer module 260. The quantity and orientation of the dividers 265-265 is an illustration, not a limitation. The dividers 265-265 define slots through which the primary winding may be threaded. The slots are suited for flat conductors or, perhaps, ribbon wire conductors. The flat conductors may be more effective at high frequencies where the skin effect (penetration depth) limits the effectiveness of round conductors.

FIG. 29 shows a folded cellular transformer section 270 that has a cellular secondary winding 271 and four magnetic cores 280-280, very similar in layout to the coaxial transformer section 81 of FIG. 10. The cellular secondary winding 271 has a first cellular winding 272 which starts at a terminal 274, passes through the four cores 280-280 and ends at a terminal 275 and a second cellular winding 273 which starts at a terminal 276, passes through the four cores 280-280 and ends at a terminal 277. When used with similar folded cellular transformer sections to make a cellular transformer, throughout the transformer there will be counter-flowing currents to cancel the far field and reduce leakage inductance, just as in the transformer 60 of FIG. 8. All of the teachings of this invention for transformers using coaxial transformer sections are applicable to transformers using cellular transformer sections, including the teachings of variable transformers. It can be seen that a cellular transformer module can be made from a coaxial transformer module by inserting a grid to define through holes for the primary winding.

Figure 30:
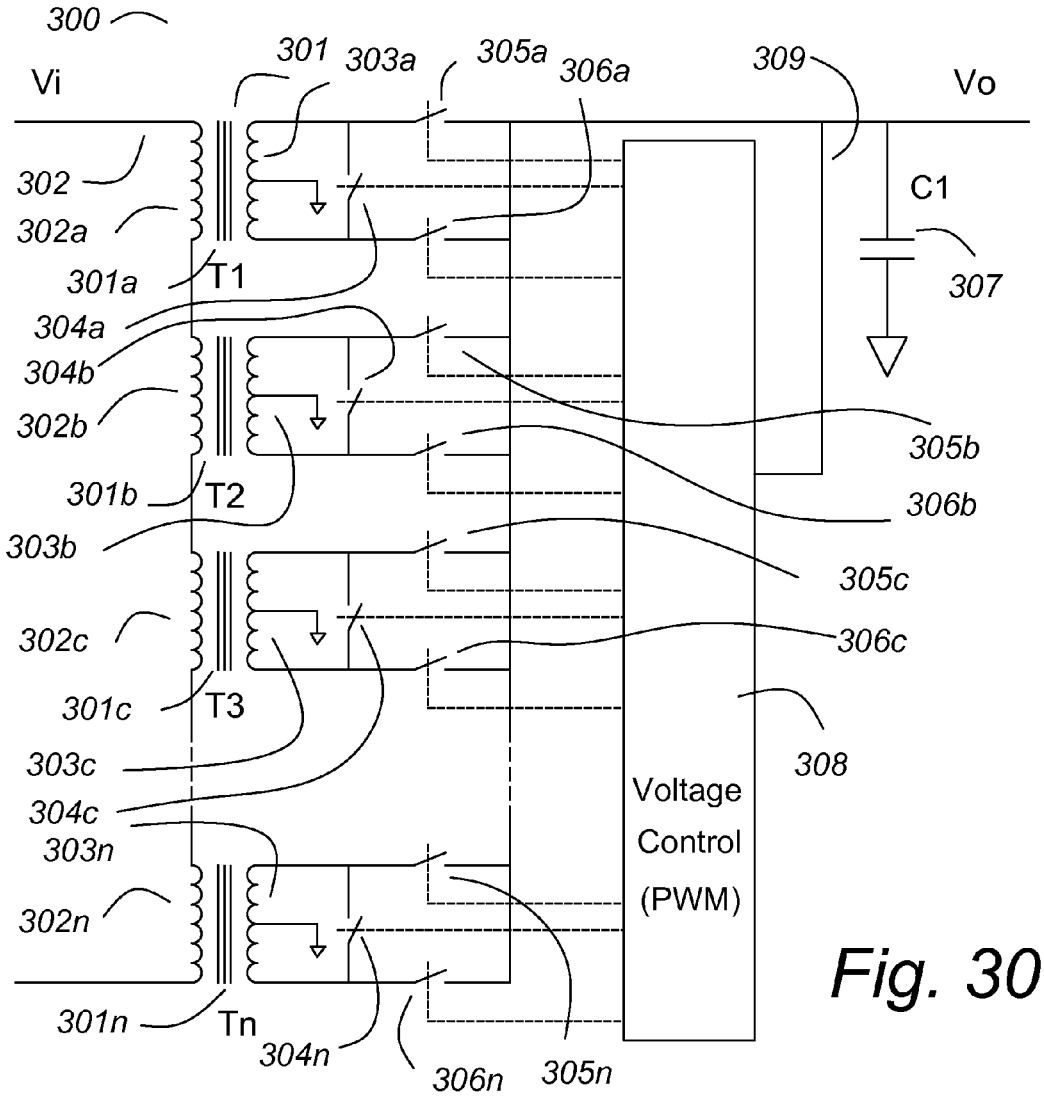
FIG. 30 shows a schematic of a variable transformer with pulse width modulated ratio control to control the output voltage precisely.

FIG. 30 shows a schematic of a generic variable transformer 300 of this invention. While it is preferred to use coaxial push-pull or cellular modules, they are examples, not limitations. General purpose transformer sections will work and may be preferred for some applications, particularly if they can use existing stock components and the high frequency characteristics are less critical.

The variable transformer of FIG. 30 has a matrix transformer 301 made of an indefinite number n of transformer sections, 301*a*, 301*b*, 301*c*-301*n*. All of the transformer sections 301*a*-301*n* have running through them as a series circuit a primary winding 302 with n sections 302*a*-302*n* associated, respectively, with the n transformer sections 301*a*-301*n*. The primary winding 302 may be a single winding, as shown, suitable for a half-bridge or full-bridge excitation, as examples, not limitations. It may also be a push-pull primary winding, such as primary winding 93 of FIG. 12.

Each of the n transformer sections 301*a*-301*n* has respectively a secondary winding 303*a*-303*n* that is a push-pull secondary winding. Each of the n secondary windings 303*a*-303*n* has its center-tap connected to return, as an example, not a limitation. In alternative circuit arrangements, the center-taps may be connected together as the output.

Each of the n transformer secondary windings 303*a*-303*n* has a first rectifier, respectively rectifiers 305*a*-305*n*, and a second rectifier, respectively rectifiers 306*a*-306*n*. The first and second rectifiers 305*a*-305*n* and 306*a*-306*n* are shown schematically as switches, but in practical circuits they may be synchronous rectifiers or diodes, as examples, not limitations. Synchronous rectifiers may be MOSFETs, and they may be turned on alternately, as would be well known by one skilled in the art of power converters. Diodes are also switches, being characterized as being on when forward biased and off when reverse biased.

At least one of the secondary windings 303*a*-303*n* has an ac shorting switch 304*a*-304*n* connected across the entire push-pull winding. When operating as a normal transformer, all of the ac shorting switches 304*a*-304*n* are open, and all of the first and second rectifiers 305*a*-305*n* and 306*a*-306*n* are operated alternatively in the usual manner of full wave rectifiers. If they are synchronous rectifiers, their drive and timing may be controlled by a control circuit 308, entitled "Voltage Control (PWM)". As shown, when operating normally, the ratio of the transformer 301 is n to 1, as is usual for matrix transformers, if the primary winding has one turn. If they are multiple turns, having p turns per section, the effective turns ratio is n p to 1, or the product of the number of sections times the number of turns per section, as is usual for matrix transformers.

Note that the number of primary turns need not be equal in every module. Unequal turns in different modules is a useful method of obtaining different transformer turns ratio. Also, the secondary windings may have a different number of turns in different modules, and it is even possible that some modules will use a push-pull secondary winding with push-pull rectifiers and others may use a single winding (either one or multiple turns) with full-bridge rectifiers. While it makes the ratio calculations more complicated, it does not change the teachings of this invention if such primary and/or secondary winding are used. For simplicity, equal whole windings are used for the examples, but it is not a limitation.

The ratio of the transformer 301 can be varied by electronic control by turning off the rectifiers 305*a*-305*n* and 306*a*-306*n* for one or more of the transformer sections 301*a*-301*n* and by turning on the respective ac shorting switch 304*a*-304*n*. If m sections remain in the normal mode (ac switch off, rectifiers normal), the transformer ratio will be m to 1, if the primary winding sections are single turn, or m p to 1 if each has p turns. If there are not equal primary turns in each module, the calculations are more complicated, but the principle is the same. When the synchronous rectifiers 305*a*-305*n* and 306*a*-306*n* for any of the transformer sections 301*a*-301*n* are operating normally, the ratio is calculated including that module in the calculation. If the synchronous rectifiers 305*a*-305*n* and 306*a*-306*n* are both off and the ac shorting switch 3034*a*-304*n* is on, for any of the transformer sections 301*a*-301*n*, the ratio is calculated as if that module were not present.

If the rectifiers 305*a*-305*n* and 306*a*-306*n* are synchronous rectifiers, both rectifiers of the section must be turned off by the control logic 308 when the respective ac switch 304*a*-304*n* is turned on. If they are diodes, they will turn off without any other action when the ac switch is turn on because both will be reversed biased.

If the ac switch 304*a*-304*n* of any section 301*a*-301*n* is turned on, that section is effectively removed from the variable transformer 300 because the ac short on the secondary will reflect to the primary 302*a*-302*n* and there will be no appreciable voltage drop in the primary winding of that section. The primary voltage drop will be across the remaining sections 301*a*-301*n* as if the section 301*a*-301*n* with its respective ac switch 304*a*-304*n* turned on were not there.

If the ac switch 304*a*-304*n* of any section 301*a*-301*n* is turned on, that section is effectively removed from the variable transformer 300 because with the rectifiers turned off, no current will reach the output capacitor 307 and the output Vo. It is as if it were not there.

Additional information on matrix transformers and prior art variable transformers can be found in a tutorial, "Design and Application of Matrix Transformers and Symmetrical Converters", a seminar given by Edward Herbert at the Fifth International High Frequency Power Conversion Conference '90, in Santa Clara, Calif., May 11, 1990.

Several figures in the tutorial show variable matrix transformers with schematic switch symbols, in particular, FIGS. 4.8 through 4.10. The tutorial and these drawings do not teach nor anticipate the use of a switch from the start to the end of a push-pull winding so that the circulating current is one half, nor would it be obvious to one skilled in the art of power converters to do so from these drawings.

In FIG. 30, the control 308 is identified as "Voltage Control (PWM)", as an example, not a limitation, as one application for a variable transformer is to make a "dc-dc transformer" which may have a precise output voltage despite line and load regulation. An output voltage sense 309 feeds back to the control 308 so that the ratio of the variable transformer is automatically varied to maintain the output voltage at a precise level. One or more of the sections may pulse-width-modulate between on and off to extrapolate between ratios.

As an example, not a limitation, let n equal 4 for the variable transformer 300 of FIG. 30. In the "normal" mode, the turns ratio is 4 to 1 for a single turn primary winding 302 or 4 p to 1 if the primary winding 302 is a multiple turn winding having p turns. If the synchronous rectifiers 305*a* and 306*b* are turned off, and the ac shorting switch 404*b* is turned on, the effective ratio will now be 3 to 1. If the ratio change is pulse width modulated, the ratio will be a value between 3 to 1 and 4 to 1. That value is continuously variable as a function of the duty-cycle of the pulse width modulation.

If two sections are pulse width modulated as described above, the ratio will vary between 2 to 1 and 4 to one. That value is continuously variable as a function of the duty-cycle of the pulse width modulation.

If it is known, for a particular design, that the ratio always has a minimum value, then some of the modules may have synchronous rectifiers only, and only the number of modules need be modulated as is required to produce that minimum value. In our example, if the transformer ratio should always be greater than 2 to 1, then only two of the modules need to be variable.

Alternatively, however, the same variable ratio can be achieved by varying the duty cycle of all of the modules by pulse width modulation. Preferably, the duty-cycles of the various modules will be off set in time (multi-phased or interleaved). This has the beneficial effect of equalizing the operating conditions of the modules. In particular, it reduces the maximum flux density in all of the modules, which will likely result in a significantly reduced total core loss.

Figure 31:
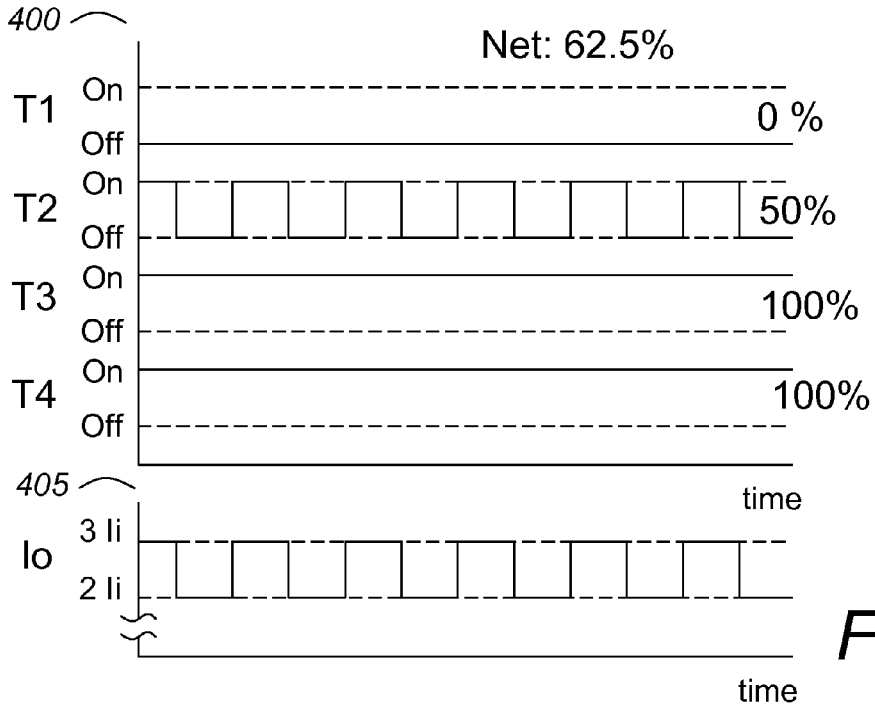
FIGS. 31 and 32 show timing diagrams for alternative sequencing for a variable transformer.

FIG. 31 shows a graph 400 of the on-off timing for a four-section variable transformer to achieve an effective turns ratio of 2.5 to 1. A first transformer T1 is off all of the time, and two transformers, T3 and T4 are on all of the time. The fourth transformer T2 is switched on and off at a 50 percent duty-cycle, for a net effective duty-cycle of 62.5 percent. Note that 62.5 percent of 4 is 2.5. This is a quite simple control. As an example, not a limitation, it could be a hysteretic control sensing the output voltage against high and low limits.

FIG. 31 also shows a graph 405, which shows the output current Io of the variable transformer as a function of the input current Ii. It can be seen that the output current Io modulates between 2 Ii and 3 Ii with a 50 percent duty-cycle.

Figure 32:
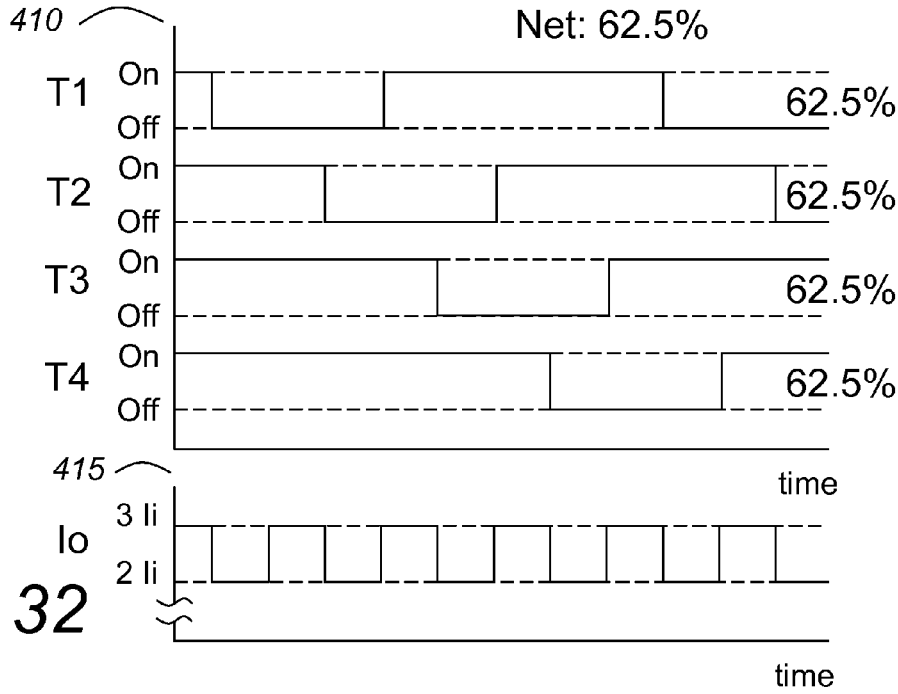

FIG. 32 shows a graph 410 of an alternative on-off timing for a four section variable transformer to achieve an effective turns ratio of 2.5 to 1. Each of the transformers T1 to T4 is switched on and off with a 62.5 percent duty-cycle. While 62.5 percent duty-cycle on-off switching of the transformers T1 through T4 could be done simultaneously, it is preferred to phase shift the switching to spread out the switching in an interleaved manner as shown in the graph 410.

FIG. 32 also shows a graph 415, which shows the output current Io of the variable transformer as a function of the input current Ii. It can be seen that the output current Io modulates between 2 Ii and 3 Ii with a 50 percent duty-cycle, exactly the same as with the on-off timing of FIG. 31. At the expense of requiring logic that is somewhat more complex, this distributes the stresses equally among the transformer sections and their switches. Further, it equalizes the maximum flux density of the transformer cores, which likely results in a net reduction of the total core loss.

There is another mode of operation that can be used with a variable transformer. In many power converters using transformers, the primary excitation is pulse width modulated to control the output voltage. To reduce the output voltage relative to the input voltage, a low duty-cycle may be needed, which decreases the efficiency. In the examples in this specification, a "100 percent" duty-cycle primary excitation is used, but this is not a limitation. The wave-form of the primary current, including pulse width modulation, does not alter the teachings of this invention, only the calculations of the output voltage which must then account for the duty-cycle of the primary excitation. A possible scenario is to use the variable ratio feature of the transformer as a "range selector" while the duty-cycle of the primary excitation is used for intermediate control of the output voltage. In this scenario, the modules of the variable transformer do not have to switch as frequently, yet the duty-cycle of the primary excitation may be kept high by changing the ratio of the variable transformer as needed.

Figure 33:
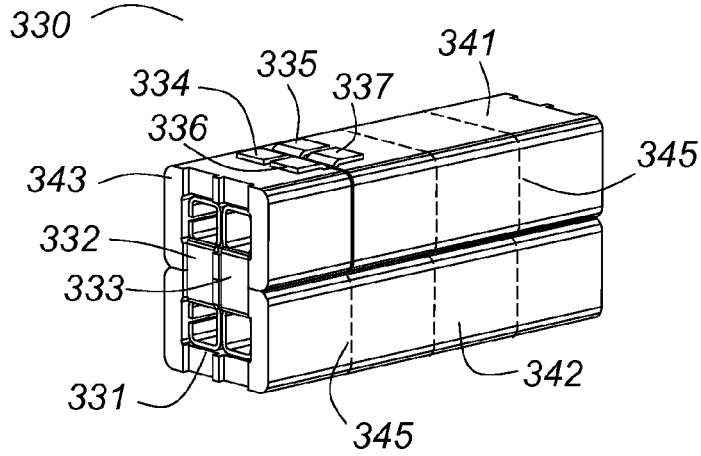
FIG. 33 shows a folded coaxial push-pull transformer section.

FIG. 33 shows a folded coaxial push-pull transformer section 330. A coaxial secondary winding 331 comprising first and second coaxial conductors 332 and 333 passes through three magnetic cores 341-343. The coaxial secondary winding 331 starts at its start terminals 335 and 337 then passes through a first magnetic core 341, then it is folded and passes back through a second magnetic core 342, then it is folded again and passes through a third magnetic core 343 to its end terminals 334 and 336, which are proximate to the start terminals 335 and 337. As compared to the folded coaxial push-pull section 192 of FIG. 20, the terminals 334-337 are offset from the center, and the three magnetic cores 341-343 are of different lengths. The first magnetic core 341 is longer and the third magnetic core 343 is shorter so that the terminals 334-337 are offset from the center. The length of the second magnetic core 342 is essentially equal to the sum of the lengths of the first and third magnetic cores 341 and 343. The first magnetic core 341 and the third magnetic core 343 are aligned end to end and together are closely proximate to and parallel with the second magnetic core 342. The dashed lines 345-345 show that the first magnetic core 341 may comprise a stack of three shorter magnetic cores and the second magnetic core 342 may comprise a stack of four shorter magnetic cores, as as examples, not limitations, so that eight cores of the size used for the third magnetic core 343 may be used to make the folded coaxial push-pull transformer section 330. In this specification and the claims, when a magnetic core is recited, it includes a stack of smaller cores, the stack having overall comparable dimensions to the recited core. One skilled in the art of transformers would know that a stack of shorter magnetic cores is magnetically equivalent to one solid magnetic core, as long as the stack has comparable overall dimensions.

Note that the switching circuits described in this specification are simplified schematics, to highlight the teachings of the invention without undue clutter. One skilled in the art of power converters and like circuits would understand how to use the invention and provide other circuits and components necessary for practical circuits. As illustrations, not limitations, there may snubbers, clamps, EMI filters, power supplies and conditioning circuits, surge protection, over current protection, and so forth. There may be additional logic and measurement circuits, and control and driver integrated circuits. There may be additional digital logic or analog circuits within or associated with a circuit to meet the requirements of a particular application.

In particular, one skilled in the art of power converters would know how to implement the various driver circuits for the various switches, the primary excitation, the rectifiers and the ac switches. He would know how to implement the timing and control circuits for pulse width modulation, phasing, interleaving and so forth, and he would know how to compensate the feedback control. A commercial power converter has a number of accessory functions that are not described here as they are not at the heart of the invention, yet they must be included in the commercial power supply. One skilled in the art of power converters would know how to use this invention as taught by this specification and would know how to integrate the accessory functions, timing and controls to make a practical power converter.

For this specification and the claims, a "high frequency matrix transformer" is a transformer as disclosed in U.S. Pat. No. 5,093,646 "High Frequency Matrix Transformer"; U.S. Pat. No. 7,023,317 "Cellular Transformers"; U.S. Ser. No. 10/904,371 "Coaxial Push-pull Transformers for Power Converters and Like Circuits" or the improved coaxial and cellular transformers disclosed in this invention. The high frequency matrix transformer comprises a plurality of transformer modules. The primary winding of the high frequency matrix transformer is wound through all of the transformer modules as in FIGS. 6, 7, 8, 9, 12 and 30, and as disclosed in U.S. Pat. No. 5,093,646 "High Frequency Matrix Transformer"; U.S. Pat. No. 7,023,317 "Cellular Transformers"; U.S. Ser. No. 10/904,371 "Coaxial Push-pull Transformers for Power Converters and Like Circuits". When so wound, the primary windings of the plurality of transformer windings are defined as being "connected in series".

The invention claimed is:

1. A variable transformer having a variable effective turns ratio comprising a high frequency matrix transformer comprising a plurality of transformer modules, each of the plurality of transformer modules having a respective transformer module primary winding, the high frequency matrix transformer having a matrix transformer primary winding comprising all of respective transformer module primary windings connected in series, each one of the plurality of transformer modules having a respective secondary winding having at least a respective start termination and a respective end termination, each one of the plurality of transformer modules having, respectively, a respective full-wave rectifier connected to the at least a respective start termination and a respective end termination of the respective secondary winding of the respective each one of the plurality of transformer modules, each of the respective full-wave rectifiers having a respective output termination, all of respective output terminations of the respective full wave rectifiers being connected in parallel as an output of the variable transformer, at least one of the plurality of transformer modules having an ac switch connected between the at least a respective start termination and the respective end termination to short-circuit the respective secondary winding of at least one of the plurality of transformer modules, and a controller for tuning on and off the ac switch and for turning off and on the respective full wave rectifiers of the at least one of the plurality of transformer modules so as to vary the effective turns ratio of the variable transformer.

2. The variable transformer of claim 1 wherein the respective secondary windings are push-pull secondary windings, and the respective full-wave rectifiers are push-pull full-wave rectifiers.

3. The variable transformer of claim 2 wherein the push-pull full wave rectifiers are synchronous rectifiers.

4. The variable transformer of claim 1 wherein the respective secondary windings are full wave secondary windings, and the respective full-wave rectifiers are full-wave bridge rectifiers.

5. The variable transformer of claim 1 wherein the plurality of transformer modules are coaxial push-pull transformer modules.

6. The variable transformer of claim 5 wherein the matrix transformer primary winding is a push-pull primary winding.

7. The variable transformer of claim 5 wherein the matrix transformer primary winding is a full wave primary winding.

8. The variable transformer of claim 1 wherein the plurality of transformer modules are cellular transformer modules.

9. The variable transformer of claim 8 wherein the matrix transformer primary winding is a push-pull primary winding.

10. The variable transformer of claim 8 wherein the matrix transformer primary winding is a full wave primary winding.

11. The variable transformer of claim 1 wherein the plurality of transformer modules are folded modules.

12. A folded transformer module for a variable transformer comprising first, second and third magnetic cores and a secondary winding, the length of the second magnetic core being essentially equal to the sum of the lengths of the first and third magnetic cores, the first and third magnetic cores being aligned end to end and together being aligned closely proximate to and parallel to the second magnetic core, the secondary winding starting at a point between the first and third magnetic cores, then passing through the first magnetic core, then being folded and passing back through the second magnetic core, then being folded back again and passing through the third magnetic core to the point between the first and third magnetic cores from which the secondary winding started.

13. The folded transformer module of claim 12 wherein the secondary winding is a push-pull secondary winding.

14. The folded transformer module of claim 13 wherein the push-pull secondary winding is a coaxial push-pull secondary winding.

15. The folded transformer module of claim 13 wherein the push-pull secondary winding is a cellular winding.

* * * * *